US009035226B1

(12) United States Patent
Jouse et al.

(10) Patent No.: US 9,035,226 B1
(45) Date of Patent: May 19, 2015

(54) CONTROL SYSTEM WITH REGENERATIVE HEAT SYSTEM

(71) Applicant: Raytheon Company, Waltham, MA (US)

(72) Inventors: Wayne C Jouse, Tucson, AZ (US); Mark S Muktoyuk, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/159,000

(22) Filed: Jan. 20, 2014

(51) Int. Cl.

| | |
|---|---|
| ***F42B 15/01*** | (2006.01) |
| ***F42B 10/62*** | (2006.01) |
| ***F42B 10/66*** | (2006.01) |
| *F42B 15/00* | (2006.01) |
| *F42B 10/00* | (2006.01) |

(52) U.S. Cl.
CPC ..... *F42B 15/01* (2013.01)

(58) Field of Classification Search
CPC ..... F42B 10/60; F42B 10/66; F42B 10/663; F42B 10/665; F42B 10/666; F42B 15/01; F02K 9/42; F02K 9/60; F02K 9/68; F02K 9/80; F02K 9/805; F02K 9/82; F02K 9/84; F02K 9/86; F02K 9/88; F02K 9/90; F02K 9/92; F02K 9/94; F02K 9/95; F02K 9/96; B64G 1/22; B64G 1/24; B64G 1/26; B64G 1/40; B64G 1/401; B64G 1/402; B64G 1/403; B64G 1/404; B64G 1/406
USPC ..... 244/3.1, 3.15, 3.21, 3.22; 60/200.1, 60/203.1, 204, 205, 219, 39.01, 39.461, 60/39.462, 722, 39.82, 39.821, 723, 60/39.822
See application file for complete search history.

(56) References Cited

U.S. PATENT DOCUMENTS

| | | | | |
|---|---|---|---|---|
| 3,079,755 | A * | 3/1963 | Forney | 60/39.821 |
| 3,142,541 | A * | 7/1964 | Presbie | 60/39.461 |
| 3,807,657 | A * | 4/1974 | Brill | 60/200.1 |
| 4,069,664 | A | 1/1978 | Ellion et al. | |
| 4,324,096 | A * | 4/1982 | Ellion | 60/200.1 |
| 4,730,449 | A * | 3/1988 | Cann | 60/39.462 |
| 4,825,647 | A * | 5/1989 | Cann | 60/203.1 |
| 5,456,425 | A | 10/1995 | Morris et al. | |
| 5,485,722 | A * | 1/1996 | Schmidt et al. | 60/219 |
| 8,084,726 | B2 | 12/2011 | Hanlon et al. | |
| 2010/0107601 | A1 | 5/2010 | Valentian | |
| 2011/1129160 | | 2/2011 | Pagliara et al. | |
| 2012/0138859 | A1 | 6/2012 | DiSalvo et al. | |

FOREIGN PATENT DOCUMENTS

| | | |
|---|---|---|
| EP | 1 477 663 A2 | 11/2004 |
| WO | 2006/003660 | 1/2006 |
| WO | 2008/045582 | 4/2008 |

* cited by examiner

*Primary Examiner* — Bernarr Gregory
(74) *Attorney, Agent, or Firm* — Renner, Otto, Boisselle & Sklar, LLP

(57) ABSTRACT

An exoatmospheric vehicle uses a control system that includes a thrust system to provide thrust to control flight of the vehicle. A regenerative heat system is used to preheat portions of the thrust system, prior to their use in control of the vehicle. The heat for preheating may be generated by consumption of a fuel of the vehicle, such as a monopropellant fuel. The fuel may be used to power a pump (among other possibilities), to pressurize the fuel for use by thrusters of the thrust system. The preheated portions of the thrust system may include one or more catalytic beds of the thrust system, which may be preheated using exhaust gasses from the pump. The preheating may reduce the response time of the thrusters that have their catalytic beds preheated. Other thrusters of the thrust system may not be preheated at all before operation.

20 Claims, 2 Drawing Sheets

CONTROL SYSTEM WITH REGENERATIVE HEAT SYSTEM

FIELD OF THE INVENTION

The present invention generally relates to exoatmospheric kill vehicles (EKVs), and more particularly relates to control systems for EKVs.

DESCRIPTION OF THE RELATED ART

Missile defense systems have been under development for several decades. One category of such defense systems is designed to target and intercept strategic missiles, such as intercontinental ballistic missiles (ICBMs), often in exoatmospheric environments (i.e., very high altitudes).

One method for disabling such strategic missiles involves having a high-speed payload collide with the missile, destroying the missile or destabilizing the flight of the missile so as to render the missile unable to reach its intended destination (target). These payloads are sometimes referred to as exoatmospheric kill vehicles (EKVs) or kinetic kill vehicles (KKVs), and are typically deployed by ground-based missile systems, perhaps through use of a booster. Once deployed, EKVs may utilize on-board sensors and electrical systems, in combination with multiple sets of thrusters, to both stabilize the kill vehicle and to alter the trajectory thereof. Due to the high speeds at which the EKV and the target are traveling (e.g., several miles per second), maintaining precise control of the vehicle is essential.

Accordingly, it is desirable to provide an improved control system for an EKV (or other maneuverable kill vehicle), bearing in mind the desirability of a fast response required for the system, and the desirability of reducing weight of objects sent outside the atmosphere. It is also desirable to minimize the use of materials that involve safety or toxicity issues that may result in handling and/or use restrictions.

SUMMARY OF THE INVENTION

A control system for an exoatmospheric vehicle includes a regenerative heat system for preheating a portion of a thrust system that is used to control course of the exoatmospheric vehicle.

According to an aspect of the invention, a control system for an exoatmospheric vehicle includes: a fuel supply containing a monopropellant fuel; a thrust system for providing thrust for controlling the course of the exoatmospheric vehicle by decomposing the monopropellant fuel from the fuel supply in the presence of a catalyst; and a regenerative heat system that is used to preheat a preheated portion of the thrust system by using heat from decomposition of the monopropellant fuel, prior to providing the monopropellant fuel to the portion of the thrust system.

According to another aspect of the invention, a control system for an exoatmospheric vehicle includes: a fuel supply containing a monopropellant fuel; and a thrust system for providing thrust for controlling the course of the exoatmospheric vehicle by decomposing the monopropellant fuel from the fuel supply in the presence of a catalyst. The thrust system includes a set of divert thrusters that are used provide lateral acceleration to the exoatmospheric vehicle without substantially changing the attitude of the exoatmospheric vehicle, wherein the set of divert thrusters includes multiple divert thruster catalytic beds, one for each of the divert thrusters, that are downstream of respective of divert thruster control valves.

According to yet another aspect of the invention, a method of operating an exoatmospheric vehicle includes the steps of: preheating portions of a thrust system using heat from decomposition of a monopropellant fuel, prior to providing the monopropellant fuel to the portion of the thrust system, wherein the preheating includes preheating using heat from decomposition of the monopropellant fuel outside of the thrust system; and controlling the course of the exoatmospheric vehicle using the thrust system, wherein the controlling includes directing the monopropellant fuel to the portions of the thrust system that were previously preheated, in order to produce thrust.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

An exoatmospheric vehicle uses a control system that includes a thrust system to provide thrust to control flight of the vehicle. A regenerative heat system is used to preheat portions of the thrust system, prior to their use in control of the vehicle. The regenerative heat system is regenerative in that it uses waste heat to heat portions of the thrust system. The heat for preheating may be generated by consumption of a fuel of the vehicle, such as a monopropellant fuel. The fuel may be used to power a pump (among other possibilities), to pressurize the fuel for use by thrusters of the thrust system. The preheated portions of the thrust system may include one or more catalytic beds of the thrust system, which may be preheated using exhaust gasses from the pump. The preheating may reduce the response time of the thrusters that have their catalytic beds preheated. Other thrusters of the thrust system may not be preheated at all before operation.

Figure 1:
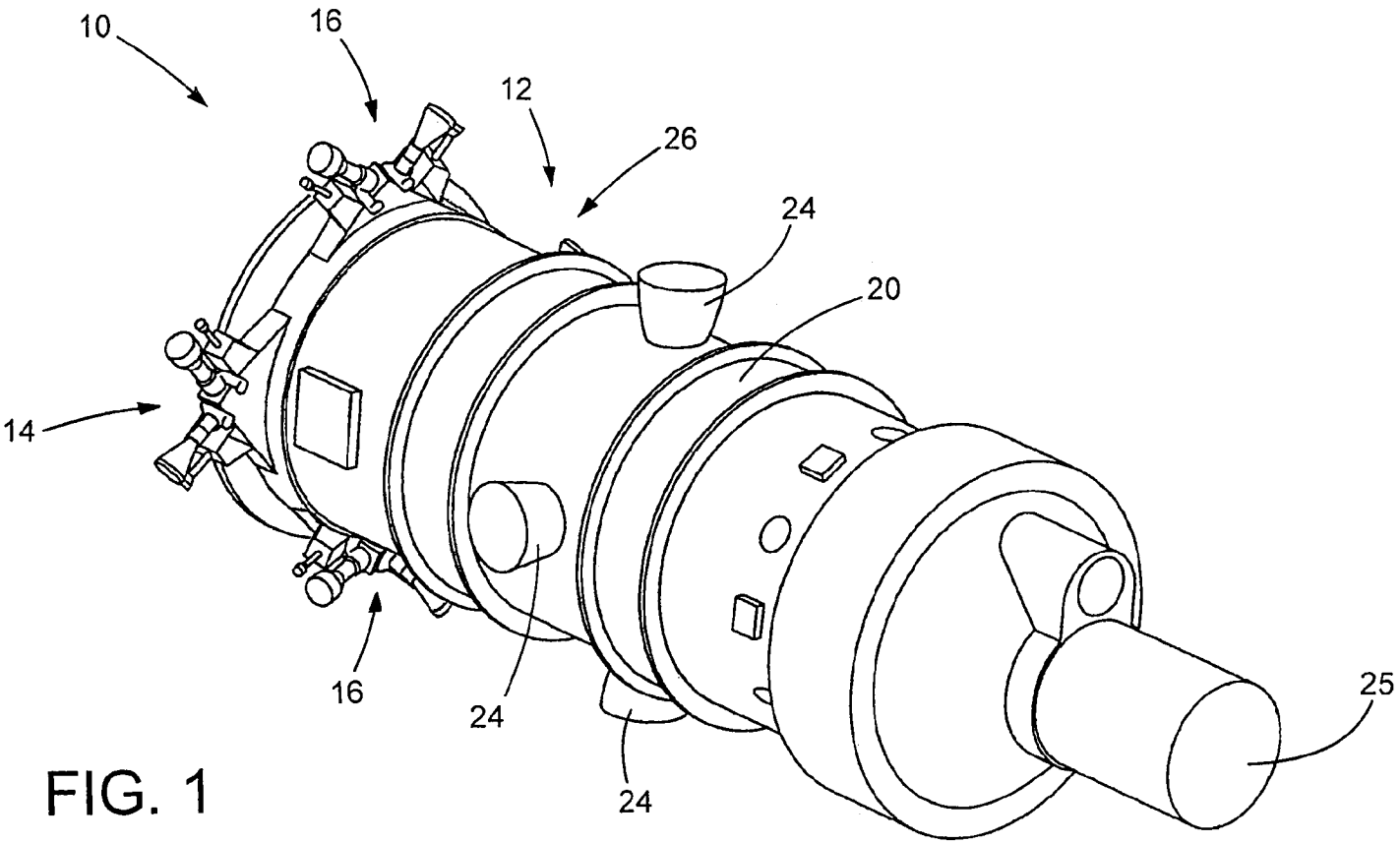
FIG. 1 is an oblique view illustrating an exoatmospheric vehicle in accordance with the present invention.

FIG. 1 shows an exoatmospheric vehicle 10 that may be used to intercept and neutralize a missile or other weapon in an exoatmospheric environment. The exoatmospheric vehicle 10 may be originally launched from a location on the Earth's surface, such as from a land location or a water vehicle such as a submarine or ship, or aircraft, as part of a larger vehicle that includes a booster (not shown) that propels the exoatmospheric vehicle 10 into high altitude. The exoatmospheric vehicle 10 may be separated from the booster at an altitude of 400 km (250 miles), and a speed of 7 km/sec, to give example values (among many possible altitudes and speeds at separation). The exoatmospheric vehicle 10 may be one of many such vehicles that are coupled to the same booster. Multiple exoatmospheric vehicles may be separately guided to different targets.

Figure 2:
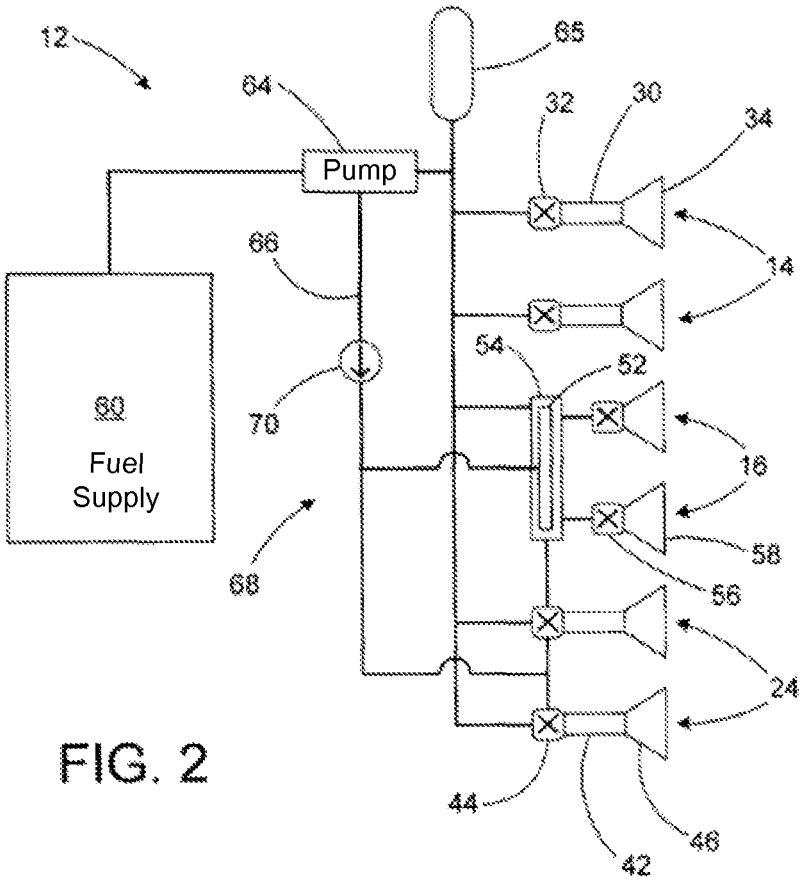
FIG. 2 is a schematic view of the control system of the exoatmospheric vehicle of FIG. 1.

With reference in addition to FIG. 2, the exoatmospheric vehicle 10 has a control system 12 that provides thrust to guide the exoatmospheric vehicle 10 to its intended target. The control system 12 may include multiple sets of thrusters, such as attitude control thrusters 14 and 16 at an aft end of a body 20 of the vehicle 10, and divert thrusters 24 at the center of the body 20. A sensor 25 (FIG. 1), such as an array of optical and/or infrared sensor elements, may be used to locate a target as the exoatmospheric vehicle 10 approaches the target. Information from the sensor 25 may be used by a controller of the control system 12, such as an integrated circuit or processor, to determine what course corrections (if any) are needed as the exoatmospheric vehicle 10 approaches its target. The thrusters 14, 16, and 24, which together constitute a thrust system 26, may be fired to accomplish this course correction, or to otherwise steer the exoatmospheric vehicle 10 on a desired path.

In the illustrated embodiment, the thrusters 14 are low level attitude control system (LLACS) thrusters, which are cold gas thrusters that are used for (relatively) low level attitude control and station keeping. Compared with the thrusters 16 and 24, which are hot gas thrusters, the LLACS thrusters 14 provide a slower response and a lower level of thrust, for example providing a thrust of 10 N. The LLACS thrusters 14 used to repeatably provide (relatively) small amounts of impulse.

The thrusters 16 are high level attitude control system (HLACS) thrusters, which are hot gas thrusters that are used for (relatively) high level attitude control and disturbance rejection, to allow precise attitude control during end game maneuvers, as the exoatmospheric vehicle 10 approaches its target. As such the HLACS thrusters 16 tend to have a higher thrust than the LLACS thrusters 14, and it is desirable that the HLACS thrusters 16 have a faster response time than the LLACS thrusters 14. To give one example value, the HLACS thrusters 16 may each be capable of providing a thrust of 400 N.

The thrusters 24 are divert control system thrusters that cause lateral movement of the exoatmospheric vehicle 10. The divert thrusters 24 are used for lateral maneuvers during the final stage of flight, before impact with the target. During the final stage of flight, there may be insufficient time for steering by changing attitude of the exoatmospheric vehicle 10. The divert thrusters 24 are hot gas thrusters that would tend to have a higher thrust but slower response time than the HLACS thrusters 16. In one example, the divert thrusters 24 may each have a thrust of 5000 N. In creating the lateral movement, the thrusters 24 do not substantially change the attitude of the exoatmospheric vehicle 10. This means that the primary course change from the divert thrusters 24 is through lateral acceleration, although some attitude change is possible as an incidental, non-intentional, secondary effect.

The illustrated embodiment shows four of each kind of thruster, with four LLACS thrusters 14, four HLACS thrusters 16, and four divert thrusters 24. Other suitable numbers of thrusters may be used instead, for instance six attitude control thrusters of each type or both types of attitude control thrusters.

The thrusters 14, 16, and 24 may be fired in appropriate combinations, with appropriate fuel flow to control thrust, and/or in appropriate sequences, in order to achieve a desired change in position and/or attitude of the exoatmospheric vehicle 10. Use of multiple thrusters to steer a vehicle is well known, and further details are therefore omitted.

In an preferred embodiment, the LLCAS thrusters 14 are cold valve catalytic bed thrusters, with each of the thrusters 14 having its own catalytic bed 30 that is downstream of the respective cold gas control valves 32 for each of the LLACS thrusters 14. The LLACS thrusters 14 have respective nozzles 34 are downstream of both the catalytic beds 30 and the control valves 32.

Similarly, the divert thrusters 24 are cold valve catalytic bed thrusters, with each of the thrusters 24 having its own catalytic bed 42 that is downstream of the respective cold gas control valves 44 for each of the divert thrusters 24. Cold gas control valves have the advantage of not needing materials capable of withstanding high temperatures, which may reduce weight and/or cost, and/or provide improved performance. The divert thrusters 24 have respective nozzles 46 are downstream of both the catalytic beds 42 and the control valves 44.

In contrast to the thrusters 14 and 24, the HLACS thrusters 16 are hot valve catalytic bed thrusters, with the HLACS thrusters 16 sharing a single catalytic bed 52 that is in a plenum 54, upstream of individual hot gas control valves 56 for each of the respective of the HLACS thrusters 16. Downstream of the control valves 56 are nozzles 58 of the HLACS thrusters 16. By having a single catalytic bed that is used by all of the HLACS thrusters 16, a savings in weight relative to a situation in which each of the thrusters has its own catalytic bed.

Alternative configurations are possible. For example, the divert thrusters 24 may alternatively have their catalytic beds upstream of their control valves, with the control valves being hot valves. As another example, the HLACS thrusters 16 may each have its own catalytic bed, rather than all sharing a catalytic bed. Many other alternatives are possible.

All of the thrusters 14, 16, and 24 use the same fuel, from a fuel supply 60. The fuel may be a suitable monopropellant. More narrowly, the fuel may be an advanced monopropellant fuel such as an ionic liquid fuel. Such an advanced monopropellant fuel or ionic liquid fuel may have a flame temperature of at least 1600° C. (2900° F.). Examples of suitable ionic monopropellant fuels include hydroxylammonium nitrate (HAN) and ammonium dinitramide (ADN). One benefit to using ionic monopropellant fuels, as opposed to other types of monopropellants (such as hydrazine), is that ionic monopropellant fuels are less hazardous, and as a result may be more acceptable for placement on a naval vessel, for example.

The catalytic beds 26, 42, and 52 may be in any of a variety of suitable materials and/or forms. One suitable catalyst is granular alumina coated with iridium. More broadly, catalysts may be suitable metals such as platinum, rhodium, iridium, other platinum group metals, or combinations thereof, and may be in any of a variety of suitable forms, such as a packed bed, wire mesh, or sponge. When the monopropellant fuel comes into contact with the catalysts, a spontaneous decomposition exothermic reaction is initiated, decomposing the fuel into gaseous elements, and in doing so releasing heat. The reaction works best when the catalytic material is at a high temperature, such as at 430-540° C. (800-1000° F.), which allows the monopropellant fuel to decompose and be expansive like a hot gas.

The cold gas control valves 32 and 44, and the hot gas control valves 56, may be of conventional configuration for controlling flow of fluids. For example, the valves may each have a valve member that is moved, such as by an actuator, to control the size of an opening that selectively allows flow The control system 12 may be self-pressurizing, with a pump 64 that is used to pump fuel from the fuel supply 60 into the system. The pump 64 may be run by any of a variety of energy sources, such as by decomposing some of the monopropellant fuel in the fuel supply 40, using a catalyst that is upstream of or integrated with the pump 64. Some of the fuel pressurized by the pump 64 is stored in an accumulator 65, to aid in maintaining pressure stability downstream of the pump.

The operation of the pump 64 produces waste heat, for example in the form of hot gasses exhausted from the pump 64 as fuel is consumed by the pump 64. The exhaust gasses may be directed out through an outline line 66 and into catalytic beds for one or both of the HLACS thrusters 16 and the divert thrusters 24. The flow at least some of the exhaust gasses may pass first through the plenum 54, preheating the HLACS thruster catalytic bed 52, and from there to the divert thrusters 24, to preheat the catalytic beds 42 of the divert thrusters 24. In preheating the divert thruster catalytic beds 42 the exhaust gases may pass through the divert thrusters 24, being exhausted from the exoatmospheric vehicle 10 through the nozzles 46 of the divert thrusters 24- and may thus operate as part of a regenerative heat system 68 for heating portions of the thrust system 26, in particular the catalytic beds 42 and 52. A check valve 70 may be placed in the outlet line 66 to prevent backflow into the pump 64.

The preheating makes for a faster response from the HLACS thrusters 16 and/or the divert thrusters 24, allowing the catalytic beds 42 and 52 to be preheated closer to a temperature that would be effective to allow the monopropellant fuel to be expansive. Starting the HLACS thrusters 16 and the divert thrusters 24 using cold (not preheated) catalytic beds requires time for their catalytic beds 42 and 52 to heat up, using the heat generated by the exothermic decomposition of the monopropellant fuel introduced into the catalytic beds 42 and 52, before the beds 42 and 52 reach an optimum temperature for catalyzing the decomposition reaction. By preheating the catalytic beds 42 and 52 for the thrusters 16 and 24, the thrusters 16 and/or 24 may have looser design criteria, allowing use of inexpensive thrusters and/or catalytic beds that would have unacceptably slow response times if operated without preheating. Thus the use of preheating may improve performance (in particular lowering effective response times), and/or may reduce complexity, weight, and/or cost of the catalytic beds 42 and/or 52, and/or other parts of the thrusters 16 and/or 24.

Figure 3:
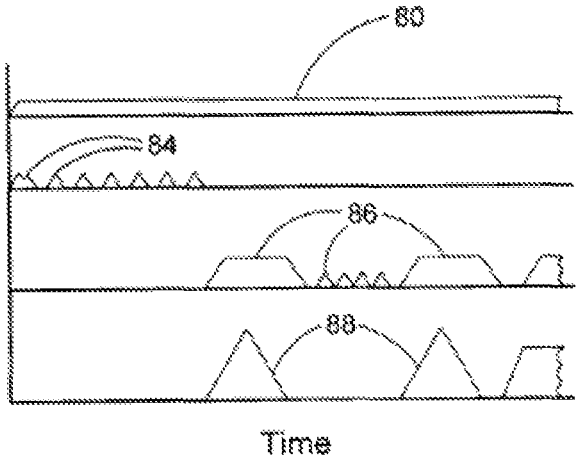
FIG. 3 is a graph illustrating an example of operation over time of components of the control system of FIG. 2.

FIG. 3 illustrates operation of various parts of the control system 12 during flight of the exoatmospheric vehicle 10. After separation from the booster (not shown) the pump 64 begins operation, maintaining the system pressure approximately constant, as shown at 80. As discussed above, the hot gas used in operating the pump 64 is used to preheat the catalytic beds of for the HLACS thrusters 16 and the divert thrusters 24.

After separation from the booster, the LLACS thrusters 14 provide small bursts of thrust 84, to change the attitude of the exoatmospheric vehicle 10, in order to steer the vehicle 10. As the exoatmospheric vehicle 10 approaches its target, the HLACS thrusters 16 and the divert thrusters 24 are engaged, providing intermittent large-thrust attitude-control pulses 86 and lateral divert thrust pulses 88. The pulses 86 and 88 are a higher level (greater thrust) than the LLACS thruster bursts 84, to provide relatively large course and/or position changes over relatively short time spans, for final maneuvering of the exoatmospheric vehicle 10. Preheating of the catalytic beds 42 and 52 allows for a faster response from the HLACS thrusters 16 and the divert thrusters 24.

The exoatmospheric vehicle 10 provides many advantages over prior exoatmospheric vehicles. These advantages may include reductions in weight, cost, and/or use of exotic materials. Also response time of the system may be reduced, which leads to other advantages. Further, the use of less-toxic fuel may allow use in sensitive environments and/or with fewer handling restrictions.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A control system for an exoatmospheric vehicle, the control system comprising:

a fuel supply containing a monopropellant fuel;

a thrust system for providing thrust for controlling the course of the exoatmospheric vehicle by decomposing the monopropellant fuel from the fuel supply in the presence of a catalyst; and a regenerative heat system that is used to preheat a preheated portion of the thrust system by using heat from decomposition of the monopropellant fuel, prior to providing the monopropellant fuel to the portion of the thrust system;

wherein the thrust system includes:

a set of attitude control thrusters that are used to change attitude of the exoatmospheric vehicle, wherein the set of attitude control thrusters includes at least one attitude control thruster catalytic bed for decomposing the monopropellant fuel passing therethrough, and respective attitude control thruster control valves for separately controlling the thrust produced by the attitude control thrusters; and a set of divert thrusters that are used provide lateral acceleration to the exoatmospheric vehicle without substantially changing the attitude of the exoatmospheric vehicle, wherein the set of divert thrusters includes at least one divert thruster catalytic bed for decomposing the monopropellant fuel passing therethrough, and respective divert thruster control valves for separately controlling the thrust produced by the divert thrusters;

wherein the preheated portion includes the at least one attitude control thruster catalytic bed and the at least one divert thruster catalytic bed; and wherein the at least one attitude control thruster catalytic bed is a single attitude control thruster catalytic bed that is upstream of and operatively coupled to all of the attitude control thruster control valves.

2. The control system of claim 1, wherein the at least one divert control thruster catalytic bed includes multiple divert thruster catalytic beds, one for each of the divert thrusters, that are downstream of respective of the divert thruster control valves.

3. The control system of claim 1, wherein the thrust system also includes an additional set of attitude control thrusters that are also used to change the attitude of the exoatmospheric vehicle, wherein the preheated portion do not include any portion of additional set of attitude control thrusters.

4. The control system of claim 1, further comprising a pump to pump fuel from the fuel supply to the thrust system;

wherein the regenerative heat system directs waste heat in the form of hot exhaust gasses from the pump to the preheated portion of the thrust system.

5. The control system of claim 4, wherein the pump operates by consuming some of the monopropellant fuel; and wherein the regenerative heat system directs hot exhaust gasses from the pump to the preheated portion of the thrust system.

6. The control system of claim 4, wherein at least some of the exhaust gasses are directed first through the at least one attitude control thruster catalytic bed, and then through the at least one divert thruster catalytic bed.

7. The control system of claim 4, further comprising an accumulator operatively coupled to the pump to maintain fuel pressure in the thrust system.

8. The control system of claim 1, wherein the monopropellant fuel is an ionic monopropellant fuel.

9. The control system of claim 8, wherein the ionic monopropellant fuel includes hydroxylammonium nitrate (HAN) or ammonium dinitramide (ADN).

10. A control system for an exoatmospheric vehicle, the control system comprising:

a fuel supply containing a monopropellant fuel; and a thrust system for providing thrust for controlling the course of the exoatmospheric vehicle by decomposing the monopropellant fuel from the fuel supply in the presence of a catalyst;

a regenerative heat system that is used to preheat a preheated portion of the thrust system; and a pump to pump fuel from the fuel supply to the thrust system;

wherein the thrust system includes a set of divert thrusters that are used to provide lateral acceleration to the exoatmospheric vehicle without substantially changing the attitude of the exoatmospheric vehicle, wherein the set of divert thrusters includes multiple divert thruster catalytic beds, one for each of the divert thrusters;

wherein the thrust system also includes a set of attitude thrusters that are used to change attitude of the exoatmospheric vehicle, wherein the set of attitude control thrusters includes at least one attitude control thruster catalytic bed; and wherein the regenerative heat system directs waste heat in the form of hot exhaust gasses from the pump to the thrust system, wherein at least some of the exhaust gasses are directed first through the at least one attitude control thruster catalytic bed and then through the multiple divert thruster catalytic beds.

11. The control system of claim 10, wherein the monopropellant fuel is an ionic monopropellant fuel.

12. The control system of claim 11, wherein the ionic monopropellant fuel includes hydroxylammonium nitrate (HAN) or ammonium dinitramide (ADN).

13. The control system of claim 10, further including attitude control thruster control valves each for separately controlling the thrust produced by a respective attitude control thruster, and divert thruster control valves each for separately controlling the thrust produced by a respective divert thruster, wherein the at least one attitude control thruster catalytic bed is upstream of the attitude control thruster control valves, and wherein each one of the multiple divert thruster catalytic beds is downstream of a different respective divert thruster control valve.

14. The control system of claim 10, further comprising an accumulator operatively coupled to the pump to maintain fuel pressure in the thrust system.

15. A method of operating an exoatmospheric vehicle, the method comprising:

preheating catalytic beds of a thrust system using heat from decomposition of a monopropellant fuel, prior to providing the monopropellant fuel to the portion of the thrust system, wherein the preheating includes preheating using heat in the form of hot exhaust gasses formed from decomposition of the monopropellant fuel outside of the thrust system;

controlling the course of the exoatmospheric vehicle using the thrust system, wherein the controlling includes directing the monopropellant fuel to the portions of the thrust system that were previously preheated, in order to produce thrust; and directing at least some hot exhaust gasses first through at least one attitude control thruster catalytic bed of an attitude control thrusters for changing attitude of the exoatmospheric vehicle, and then through at least one divert control thruster catalytic bed of a divert thruster for providing lateral acceleration to the exoatmospheric vehicle.

16. The method of claim 15, wherein the preheating includes using exhaust gases from operation of a pump to preheating the portions of the thrust system.

17. The method of claim 15, wherein the portions of the thrust system includes catalytic beds; and wherein the controlling includes decomposing the monopropellant fuel in the catalytic beds to produce the thrust.

18. The method of claim 17, wherein the catalytic beds include catalytic beds for both attitude control thrusters and divert thrusters; and wherein the controlling includes controlling using both the attitude control thrusters and the divert thrusters.

19. The method of claim 18, wherein the thrust system includes additional attitude control thrusters that are fired without preheating.

20. The method of claim 15, further including maintaining fuel pressure in the thrust system via an accumulator operatively coupled to the thrust system.

* * * * *